US012733704B2

(12) United States Patent
Labrosse-Girard et al.

(10) Patent No.: US 12,733,704 B2
(45) Date of Patent: Sep. 15, 2026

(54) LOWER PROTECTIVE CAGE FOR A HELMET AND HELMET HAVING SAME

(71) Applicant: 9416-3441 QUEBEC INC., Anjou (CA)

(72) Inventors: Loic Labrosse-Girard, Anjou (CA); Dominic Daigle, Boucherville (CA)

( * ) Notice: Subject to any disclaimer, the term of this patent is extended or adjusted under 35 U.S.C. 154(b) by 211 days.

(21) Appl. No.: 17/783,031

(22) PCT Filed: Dec. 4, 2020

(86) PCT No.: PCT/CA2020/051675
§ 371 (c)(1),
(2) Date: Jun. 7, 2022

(87) PCT Pub. No.: WO2021/108924
PCT Pub. Date: Jun. 10, 2021

(65) Prior Publication Data

US 2023/0009694 A1 Jan. 12, 2023

Related U.S. Application Data

(60) Provisional application No. 63/033,551, filed on Jun. 2, 2020.

(30) Foreign Application Priority Data

Dec. 7, 2019 (CA) ..... CA 3064232

(51) Int. Cl.
*A42B 3/20* (2006.01)
*A42B 3/22* (2006.01)

(52) U.S. Cl.
CPC . *A42B 3/20* (2013.01); *A42B 3/22* (2013.01)

(58) Field of Classification Search
CPC ..... A42B 3/20; A42B 3/22
See application file for complete search history.

(56) References Cited

U.S. PATENT DOCUMENTS 261,408 A * 7/1882 Turner ..... A42B 1/046 2/4
2,398,269 A * 4/1946 Young ..... A61F 9/06 2/8.1

(Continued)

FOREIGN PATENT DOCUMENTS

WO 2020044020 A1 3/2020

OTHER PUBLICATIONS

International Search Report and Written opinion issued in corresponding International application No. PCT/CA2020/051675 on Mar. 12, 2021.

*Primary Examiner* — Robert H Muromoto, Jr.

(57) ABSTRACT

A helmet has an outer shell having a front portion, left and right lateral portions, a top portion and a rear portion. A visor is positioned to protect a user's eyes and is connected to the outer shell. A lower protective cage for protecting a lower portion of the user's face includes: a left connector and a right connector adjustably connected to the left lateral portion and the right lateral portion of the outer shell respectively so that a position of the lower protective cage relative to the outer shell is adjustable via connection of the left and right connectors to the outer shell; and a cage portion extending laterally between the left and right connectors, the cage portion being positioned so as to protect the lower portion of the user's face, at least a majority of the cage portion extending lower than the visor.

12 Claims, 7 Drawing Sheets

(56) References Cited

U.S. PATENT DOCUMENTS 2,908,911 A * 10/1959 Sowle ..... A42B 3/20 2/9
3,613,115 A * 10/1971 Hill ..... A61F 9/025 2/10
3,727,235 A * 4/1973 Fisher ..... A42B 3/222 2/10
4,021,858 A * 5/1977 Neeld ..... A42B 3/08 2/9
4,042,974 A * 8/1977 Morgan ..... A42B 3/326 2/9
4,370,759 A * 2/1983 Zide ..... A63B 71/10 2/9
4,885,806 A * 12/1989 Heller ..... A42B 3/326 2/424
5,093,936 A * 3/1992 Copeland ..... A42B 3/14 2/9
RE34,699 E * 8/1994 Copeland ..... A42B 3/14 2/9
5,384,914 A * 1/1995 Caveness ..... A42B 3/20 2/9
5,406,944 A * 4/1995 Gazzara ..... A62B 18/082 128/201.12
5,483,699 A * 1/1996 Pernicka ..... A42B 3/22 2/9
5,539,936 A * 7/1996 Thomas ..... A42B 3/0406 2/9
6,301,719 B1 * 10/2001 Goodhand ..... A42B 3/20 24/324
6,499,139 B1 * 12/2002 Brown ..... A63B 71/10 2/9
6,883,183 B2 * 4/2005 Morrow ..... A42B 3/08 2/9
9,179,728 B2 * 11/2015 Pfanner ..... A42B 3/166
11,229,254 B1 * 1/2022 Matteucci ..... A42B 3/063
2002/0174480 A1 * 11/2002 Lombard ..... A42B 3/20 2/424
2004/0040073 A1 * 3/2004 Morrow ..... A42B 3/205 2/424
2006/0080761 A1 * 4/2006 Huh ..... A61F 9/06 2/10
2007/0250992 A1 * 11/2007 Brown ..... A42B 3/20 2/424
2008/0000001 A1 * 1/2008 Benvenuto ..... A42B 3/20 2/15
2012/0180204 A1 * 7/2012 Hawkins ..... A42B 3/226 351/159.64
2013/0219595 A1 * 8/2013 Musal ..... A42B 3/205 2/424
2013/0340147 A1 * 12/2013 Giles ..... A42B 3/22 2/412
2014/0143940 A1 * 5/2014 Iuliano ..... A42B 3/046 2/422
2015/0026858 A1 * 1/2015 Ross ..... A42B 3/18 2/2.5
2015/0135413 A1 * 5/2015 Mayerovitch ..... A42B 3/125 2/425
2016/0000167 A1 * 1/2016 Alley ..... A42B 3/22 2/412
2016/0286890 A1 * 10/2016 Morin ..... A42B 3/221
2017/0100659 A1 * 4/2017 Blecher ..... A63B 71/081
2018/0125144 A1 * 5/2018 Knight ..... A63B 71/10
2019/0021431 A1 * 1/2019 Brine, III ..... A63B 71/10
2019/0223537 A1 * 7/2019 Pfanner ..... A42B 3/225
2019/0344152 A1 * 11/2019 Popejoy ..... A63B 71/12
2020/0315280 A1 * 10/2020 Kaye ..... A42B 3/20
2022/0125148 A1 * 4/2022 McDermott ..... A42B 3/20

* cited by examiner

LOWER PROTECTIVE CAGE FOR A HELMET AND HELMET HAVING SAME

CROSS-REFERENCE

The present application claims priority from U.S. Provisional Patent Application No. 63/033,551, filed on Jun. 2, 2020, and from Canadian Patent Application No. 3,064,232, filed on Dec. 7, 2019, the entirety of each of which is incorporated herein by reference.

FIELD OF TECHNOLOGY

The present technology relates to helmets.

BACKGROUND

Various sports require the use of a helmet to protect a user's head. In some cases, it may be desirable to provide protection for the user's face. For instance, hockey helmets are sometimes equipped with a protective cage to protect the user's face from impacts while playing (e.g., from a puck or a stick). Hockey helmets can also alternatively be provided with a visor which may be preferred for an unencumbered vision of the user (in contrast to the protective cage) while protecting an upper portion of the user's face.

However, visors provide incomplete protection of the user's face as the lower portion of the user's face remains exposed. In the case of protective cages, they can be intrusive in the user's field of vision and, moreover, as they are often installed loosely on the helmet for practicality, they can frequently move during use. This can be problematic as a chin cup attached to the protective cage can be pushed into the user's face when the protective cage is impacted. Other protective solutions may also lack in adjustability and/or comfort. These problems may also be applicable to helmets other than a hockey helmet.

In view of the foregoing, there is a need for a helmet that addresses at least some of these drawbacks.

SUMMARY

It is an object of the present technology to ameliorate at least some of the inconveniences present in the prior art.

According to an aspect of the present technology, there is provided a helmet. The helmet includes: an outer shell having a front portion, left and right lateral portions, a top portion and a rear portion; a visor positioned to protect a user's eyes when the user wears the helmet, the visor being connected to the outer shell; and a lower protective cage for protecting a lower portion of the user's face. The lower protective cage includes: a left connector and a right connector adjustably connected to the left lateral portion and the right lateral portion of the outer shell respectively so that a position of the lower protective cage relative to the outer shell is adjustable via connection of the left and right connectors to the outer shell; and a cage portion extending laterally between the left and right connectors, the cage portion being positioned so as to protect the lower portion of the user's face when the user wears the helmet, at least a majority of the cage portion extending lower than the visor.

In some embodiments, the lower protective cage is generally U-shaped when viewed from a front of the sports helmet.

In some embodiments, the position of the lower protective cage is vertically adjustable via the left and right connectors.

In some embodiments, the position of the lower protective cage is adjustable along a front-back axis of the helmet via the left and right connectors.

In some embodiments, the position of the lower protective cage relative to the outer shell is rotationally adjustable via the left and right connectors.

In some embodiments, each of the left and right connectors is fastened to the outer shell by a plurality of threaded fasteners.

In some embodiments, for each of the left and right connectors: the connector defines a slot; at least two fasteners of the plurality of threaded fasteners extend through the slot to secure the connector to a corresponding one of the left and right lateral portions of the outer shell; and the position of the lower protective cage relative to the outer shell is adjusted by moving the at least two fasteners along the slot.

In some embodiments, the slot extends substantially vertically.

In some embodiments, the slot extends upwardly and rearwardly from a lower end to an upper end of the slot.

In some embodiments, each of the left and right connectors includes a connector body and a peripheral wire portion at least partly surrounding the connector body, the peripheral wire portion being continuous with a wire forming the cage portion of the lower protective cage.

In some embodiments, the fasteners extend through the left and right connectors of the lower protective cage and through the visor so as to connect both the lower protective cage and the visor to the outer shell.

In some embodiments, the visor includes left and right visor connecting portions that are connected to the left and right lateral portions of the outer shell respectively; and the left and right connectors of the lower protective cage overlap the left and right visor connecting portions of the visor respectively.

In some embodiments, the left and right visor connecting portions of the visor are disposed between the outer shell and the left and right connectors of the lower protective cage.

In some embodiments, the left and right connectors extend vertically higher than the cage portion.

In some embodiments, the cage portion includes: a plurality of laterally-extending wires; and a plurality of vertically-extending wires connected to the laterally-extending wires to form a cage-like geometry of the cage portion.

In some embodiments, the left and right connectors are connected to the outer shell solely at the left and right lateral portions thereof.

In some embodiments, each of the left and right lateral portions of the outer shell defines a respective ear aperture; and the left and right connectors of the lower protective cage are connected to the left and right lateral portions of the outer shell forwardly of the ear apertures.

In some embodiments, the helmet also includes left and right ear guards connected to the outer shell to at least partially cover the ear apertures.

In some embodiments, a spacing between the left and right connectors is adjustable by inserting at least one spacer between each of the left and right connectors and the left and right lateral portions of the outer shell respectively.

In some embodiments, the helmet is a sports helmet.

According to another aspect of the present technology, there is provided a lower protective cage for a helmet. The lower protective cage includes a left connector and a right connector configured to be adjustably connected to a left lateral portion and a right lateral portion of an outer shell of the helmet respectively, each of the left and right connectors defining a slot configured to receive fasteners therethrough to adjustably connect the left and right connectors to the outer shell of the helmet, the slot extending substantially vertically so that a position of lower protective cage relative to the outer shell of the helmet is vertically adjustable via the left and right connectors. The lower protective cage also includes a cage portion for protecting a lower portion of the user's face, the cage portion extending laterally between the left and right connectors.

In some embodiments, the lower protective cage is generally U-shaped when viewed from a front thereof.

In some embodiments, the slot extends upwardly and rearwardly from a lower end to an upper end of the slot so that the position of the lower protective cage relative to the outer shell of the helmet is adjustable along a front-back axis of the helmet via the left and right connectors.

In some embodiments, the left and right connectors extend upwardly from the cage portion.

In some embodiments, the cage portion includes: a plurality of laterally-extending wires; and a plurality of vertically-extending wires connected to the laterally-extending wires to form a cage-like geometry of the cage portion.

In some embodiments, each of the left and right connectors includes: a connector body defining the slot of the connector; and a peripheral wire portion at least partly surrounding the connector body, the peripheral wire portion being continuous with a wire of one of the plurality of laterally-extending wires or of one of the plurality of vertically-extending wires.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
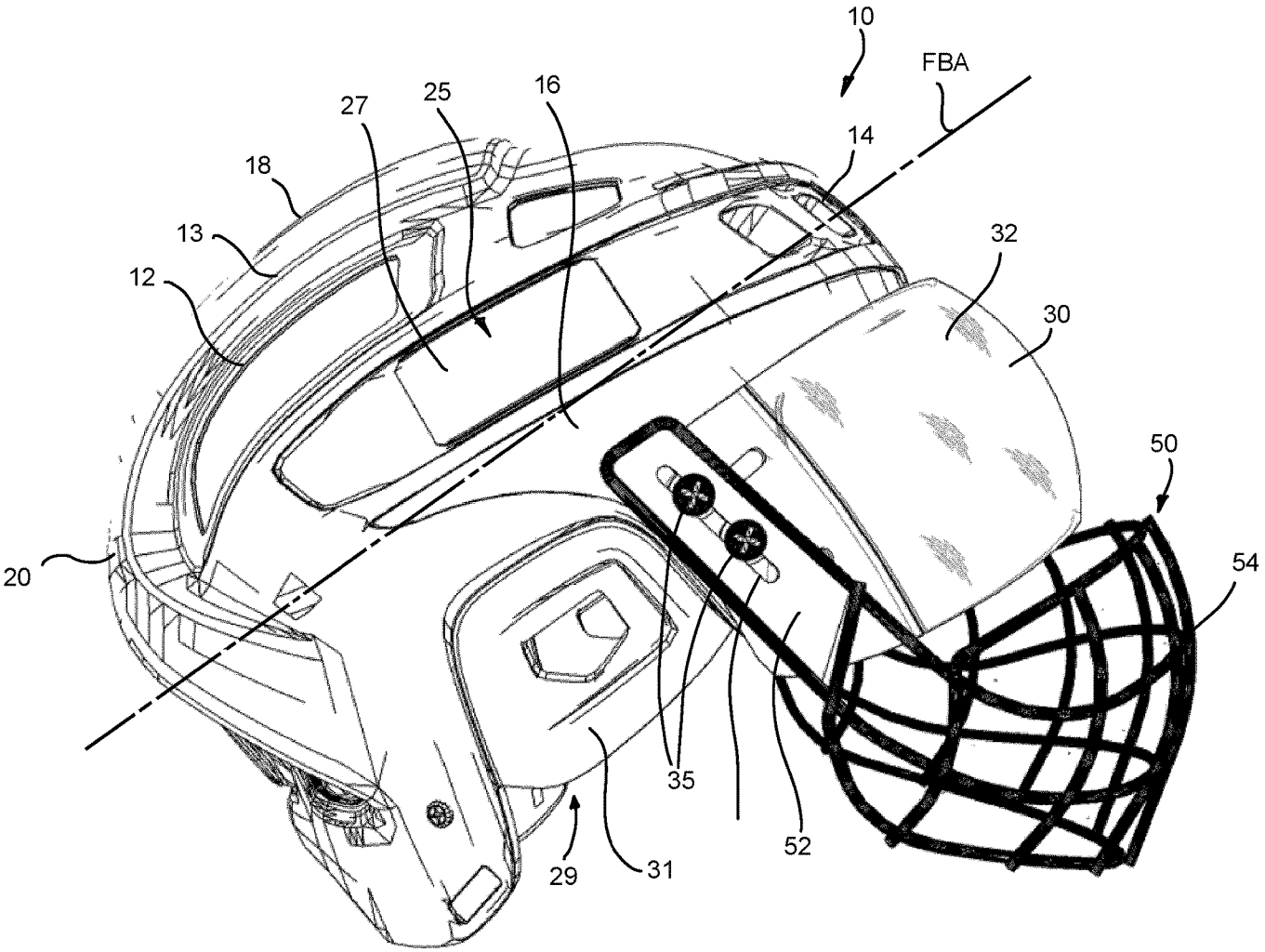
FIG. 1 is a right side elevation view of a sports helmet according to an embodiment of the present technology.
Figure 2:
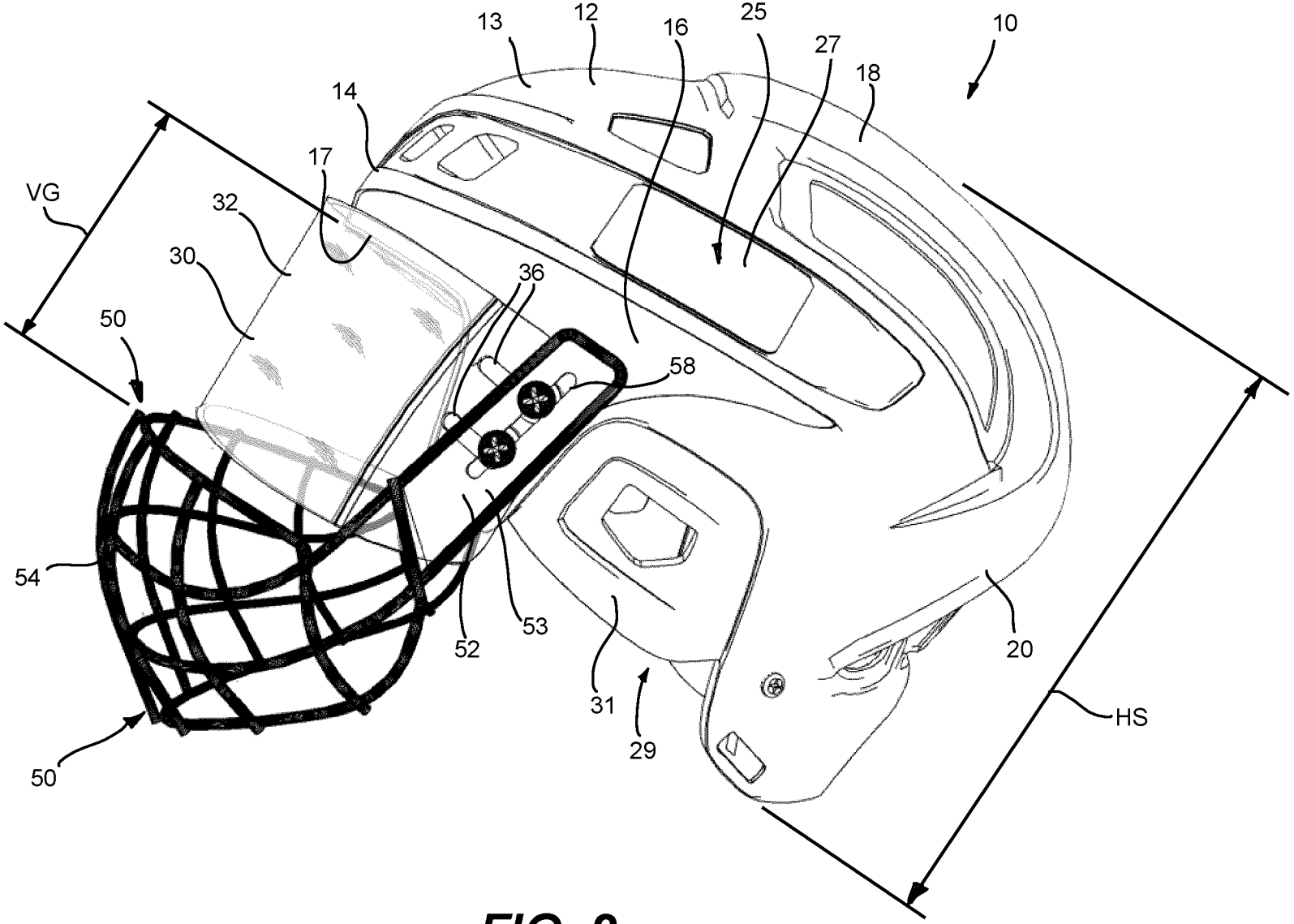
FIG. 2 is a left side elevation view of the sports helmet of FIG. 1.
Figure 3:
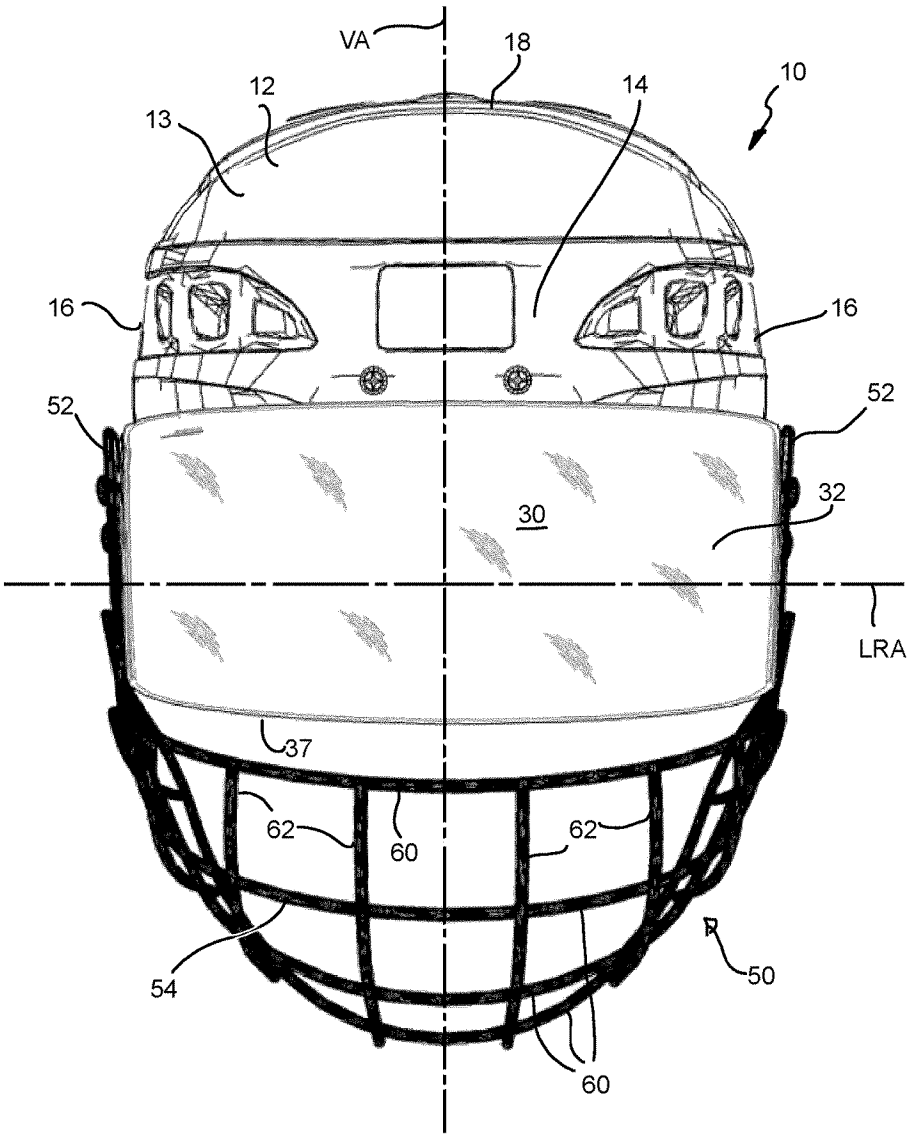
FIG. 3 is a front elevation view of the sports helmet of FIG. 1.
Figure 4:
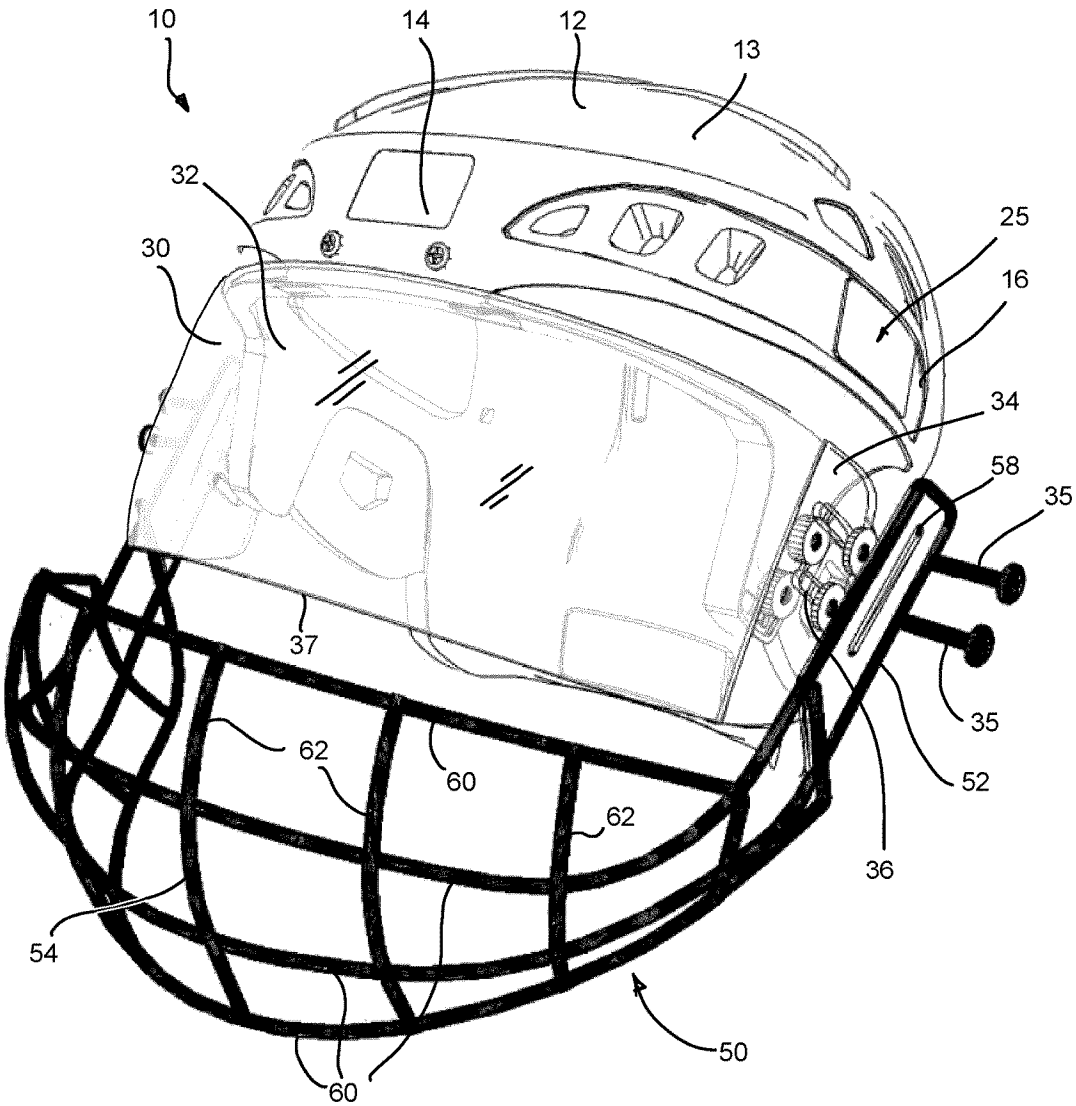
FIG. 4 is an exploded view of the sports helmet of FIG. 1.
Figure 5:
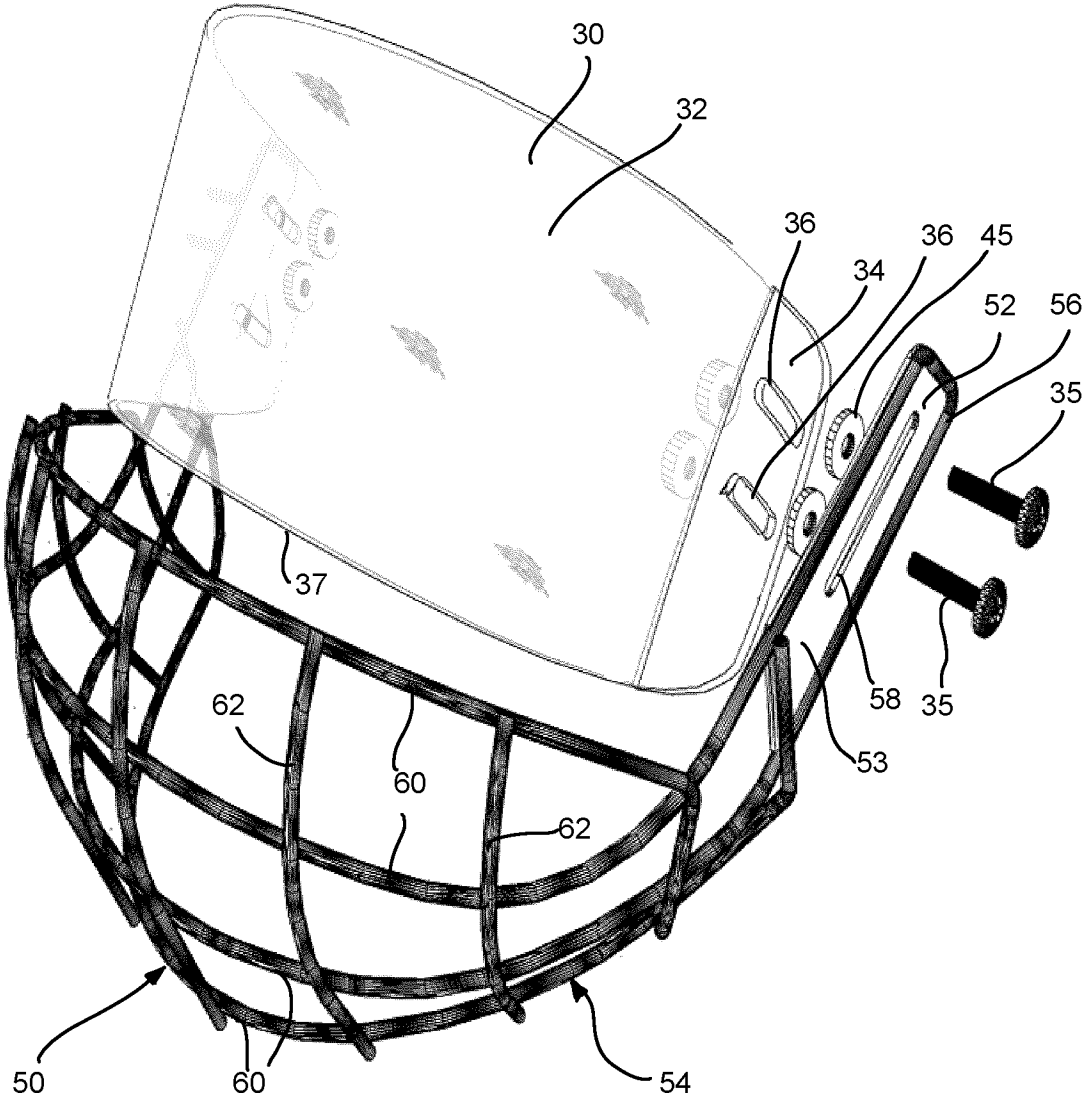
FIG. 5 is an exploded view of a visor and a lower protective cage of the sports helmet of FIG. 1, shown from a front, left side perspective.

With reference to FIGS. 1 to 3, a sports helmet 10 in accordance with an embodiment of the present technology is shown. The following description relates to one example of the sports helmet 10, notably a hockey helmet 10. As such, in use, the hockey helmet 10 protects a hockey player's head. Those of ordinary skill in the art will recognize that there are other known types of helmets incorporating different designs and that the present technology would encompass these other helmets, such as sports helmets for lacrosse, football, baseball, cricket, etc. and helmets for other uses (e.g., industrial and military applications).

For ease of reference, in the present application, terms related to orientation, direction and positioning used in describing the helmet 10 and its components, such as "front", "rear", "left", "right", "top", "bottom", "horizontal", "vertical", "lateral", etc., are understood to be interpreted by a person wearing the helmet 10 with his/her head positioned level (i.e., not tilted upward or downward). As shown in FIGS. 1 and 3, the helmet 10 has a front-back axis FBA, a left-right axis LRA, and a vertical axis VA which ascertain these directions.

The helmet 10 includes an outer shell 12 which provides strength and rigidity to the helmet 10. The outer shell 12 has a front portion 14 for protecting a front part of the user's head, left and right lateral portions 16 for protecting left and right sides of the user's head, a top portion 18 for protecting a top of the user's head, and a rear portion 20 for protecting a rear part of the user's head. As shown in FIG. 2, the front portion 14 defines a lower front edge 17 extending generally laterally which is configured to be aligned with the user's forehead when the user wears the helmet 10. The outer shell 12 has an outer surface 13 facing away from the user's head when the user wears the helmet 10. The outer surface 13 constitutes at least part of an external surface of the helmet 10. The outer shell 12 is made of a rigid material. For instance, the outer shell 12 may be made of a thermoplastic material. In this embodiment, the outer shell 12 is made of polyethylene. It is contemplated that the outer shell 12 could be made of any other suitable material in other embodiments.

The outer shell 12 defines a plurality of vent openings 23 for promoting ventilation of the user's head. For instance, as shown in FIGS. 1 and 2, some of the vent openings 23 are located at the front portion 14 of the outer shell 12.

In this embodiment, a fit adjustment system 25 is provided for selectively increasing or decreasing a size of the outer shell 12 (e.g., a distance between the most distant points of the front portion 14 and the rear portion 20 of the outer shell 12) so as to assist the user in obtaining the right fit of the helmet 10 on his/her head. Notably, as shown in FIGS. 1 and 2, the fit adjustment system 25 includes a lock lever 27 located at each of the lateral portions 16 of the outer shell 12 which can be actuated by the user to lock and unlock the fit adjustment system 25. The outer shell 12 may thus comprise two separate members that are in sliding engagement with one another. Such fit adjustment systems are known and therefore will not be described in detail herein.

As can be seen in FIGS. 1 and 2, each of the left and right lateral portions 16 of the outer shell 12 defines a respective ear aperture 29 which, when the helmet 10 is worn by the user, is aligned with a corresponding one of the user's ears. In this embodiment, the helmet 10 has left and right ear guards 31 connected to the outer shell 12 so as to at least partially cover the left and right ear apertures 29 and thereby protect the user's ears.

An inner lining (not shown) of the helmet 10 is disposed inside of the outer shell 12 and is attached thereto. Thus, in use, the inner lining lies between the outer shell 12 and the user's head. The inner lining is configured to absorb energy to minimize energy transmitted to the user's head when the outer shell 12 is subjected to impacts (e.g., when the helmet 10 hits a board or an ice surface of a hockey rink, a puck, etc.). The inner lining can be made of polystyrene or any other suitable energy-absorbing material.

As can be seen, the outer shell 12 leaves the user's face relatively unprotected (other than the user's forehead which is protect by the front part 14). Therefore, the helmet 10 also includes a visor 30 (sometimes referred to as a "shield") connected to the outer shell 12 and positioned to protect an upper portion of the user's face, including the user's eyes. The visor 30 may also protect the user's nose.

The visor 30 is generally U-shaped and has a central portion 32 that extends over the user's face when the user wears the helmet 10, and left and right visor connecting portions 34 between which the central portion 32 extends. In particular, the central portion 32 has a generally continuous outer surface extending between the visor connecting portions 34. The left and right visor connecting portions 34 define the lateral ends of the visor 30. The left and right visor connecting portions 34 are adjustably connected to the left and right lateral portions 16 of the outer shell 12 (i.e., the position of the visor 30 can be adjusted via the left and right visor connecting portions 34). Notably, each of the left and right visor connecting portions 34 defines two generally parallel slots 36 vertically spaced from one another. As can be seen, the slots 36 extend generally horizontally (i.e., parallel to a direction of the front-back axis FBA of the helmet 10). To affix the visor 30 to the outer shell 12, a respective fastener 35 is inserted in a corresponding one of the two slots 36 and into a fastener opening (not shown) defined by the corresponding lateral portion 16 of the outer shell 12. Threaded tabs (not shown) are mounted to the outer shell 12, on an interior side thereof, to receive the fasteners 35. The fastener openings and the threaded tabs are positioned forwardly of the ear apertures 29. The fasteners 35 can be loosened to adjust the position of the visor 10 relative to the outer shell 12, namely by moving the visor 30 along the front-back direction such that the fasteners 35 move along the slots 36.

The visor 30 is substantially transparent to allow the user to see therethrough. This is in contrast for example to conventional protective cages used in some hockey helmets which can encumber the user's field of vision. In this embodiment, the visor 30 is made of polycarbonate. The visor 30 may be made of any other suitable material in other embodiments.

It is contemplated that, in some embodiments, the visor 30 may be omitted. For instance, in some cases, a user may not be comfortable wearing a visor and may thus use the helmet 10 without a visor.

A lower protective cage 50 is positioned to protect a lower portion of the user's face, namely including the user's jaw and his/her mouth. Thus, together, the lower protective cage 50 and the visor 30 protect the entirety of the user's face. In addition, the lower protective cage 50 may also protect in part the upper portion of the user's face since a visor alone could still potentially allow a stick to slip underneath the visor and cause harm to the upper portion of the user's face.

The lower protective cage 50 is generally U-shaped when viewed from a front thereof (i.e., the front of the helmet 10), as shown in FIG. 3. With reference to FIGS. 8 to 10, the lower protective cage 50 has left and right connectors 52 that are adjustably connected to the left and right lateral portions 16 of the outer shell 12 respectively, as will be discussed in greater detail below. The lower protective cage 50 has a central cage portion 54 that extends laterally between the left and right connectors 52. When the lower protective cage 50 is connected to the outer shell 12, the cage portion 54 is disposed vertically lower than the left and right connectors 52. In other words, the left and right connectors 52 extend upwardly from respective left and right ends of the cage portion 54. As such, the left and right connectors 52 define the uppermost edges of the lower protective cage 50.

As can be seen in FIGS. 1 to 3, in this embodiment, a majority (i.e., a majority or an entirety) of the cage portion 54 extends vertically lower than the visor 30. The cage portion 54 is the portion of the lower protective cage 50 that protects the part of the user's face below the visor 30. The cage portion 54 is curved such that the lateral sides thereof curve rearwardly (to protect the sides of the lower portion of the user's face). The cage portion 54 has a plurality of laterally-extending wires 60 extending generally laterally. The laterally-extending wires 60 are curved such that they also extend rearwardly from a central part of the cage portion 54. The cage portion 54 also has a plurality of vertically-extending wires 62 spaced apart from one another and extending generally vertically. The vertically-extending wires 62 are curved such that they also extend rearwardly from an upper part of the cage portion 54. The wires 60, 62 are connected to one another, notably welded to one another, to form a cage-like geometry of the cage portion 54 (i.e., a grid configuration). Notably, grid-like gaps 63 are defined between the wires 60, 62. As can be seen, a topmost one of the laterally-extending wires 60 is vertically spaced from a lower edge 37 of the visor 30. As such, the topmost one of the laterally-extending wires 60 is also vertically spaced from the lower front edge 17 of the front portion 14 of the outer shell 12. For instance, with reference to FIG. 2, in some cases, a ratio VG/HS of a vertical distance VG between the topmost one of the laterally-extending wires 60 and the lower front edge 17 over a height HS of the outer shell 12 of the helmet 10 may be between 0.3 and 0.5, and in some cases between 0.4 and 0.5. In this embodiment, the ratio VG/HS is approximately 0.4 (i.e., ±0.05).

When the user wears the helmet 10, the cage portion 54 is disposed in front of the user's chin and spaced therefrom. In some embodiments, an optional chin cup may be provided connected to the cage portion 54 to support the user's chin.

As mentioned above, the left and right connectors 52 are adjustably connected to the left and right lateral portions 16 of the outer shell 12 respectively such that a position of the lower protective cage 50 can be adjusted by adjusting the connection of the left and right connectors 52 to the outer shell 12. Notably, as will be described below, the vertical position of the lower protective cage 50 can be adjusted via the left and right connectors 52.

The left and right connectors 52 are mirror images of one another and therefore only the left connector 52 will be described herein. It is to be understood that the same description applies to both connectors 52. The connector 52 has a connector body 53 surrounded by a peripheral wire portion 56 that is welded to the connector body 53. In particular, in this embodiment, the connector body 53 is spot welded at various points around its periphery to the peripheral wire portion 56 The connector body 53 is generally planar and has an elongated quadrilateral shape. The peripheral wire portion 56 is a wire that has the quadrilateral shape of the connector body 53. As shown in FIG. 9, the peripheral wire portion 56 is continuous with two of the laterally-extending wires 60. The connector body 53 defines a slot 58 (i.e., an elongated rectilinear aperture). As can be seen in FIGS. 1 and 2, the slot 58 extends substantially vertically (i.e., substantially parallel to the vertical axis VA), notably extending upwardly from a lower end to an upper end of the slot 58. However, the slot 58 also extends slightly rearwardly from the lower end of the slot 58 to the upper end of the slot 58. As will be explained below, this orientation of the slot 58 allows the lower protective cage 50 to be adjusted vertically but also to some degree forwardly/rearwardly. As will be described below, the threaded fasteners 35 which are used to connect the visor 30 to the outer shell 12 also connect the left and right connectors 52 of the lower protective cage 50 to the outer shell 12 via the slots 58.

It is contemplated that, in other embodiments, each of the left and right connectors 52 could define more than one slot 58, and that each of the two fasteners 35 engaging that connector 52 engages a corresponding one of the slots.

In this embodiment, the lower protective cage 50 is made of metallic material (e.g., steel) and its components are all welded to one another. The lower protective cage 50 could be made from any other suitable in other embodiments. For instance, in some embodiments, the lower protective cage 50 could be made of polymeric material, a composite material, or any other suitable material (or combinations thereof).

Figure 6:
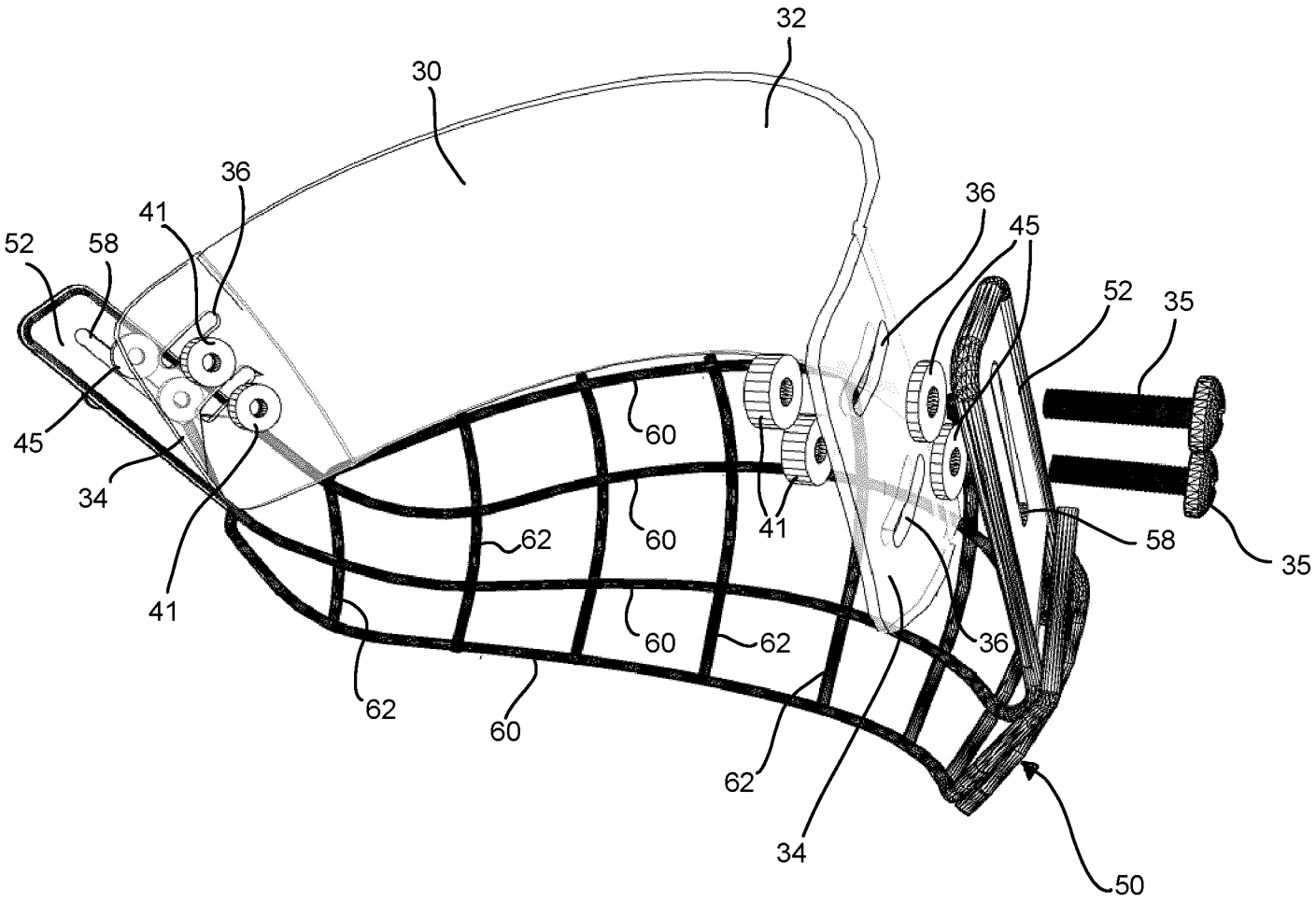
FIG. 6 is an exploded view of the visor and the lower protective cage of FIG. 5, shown from a rear, right side perspective.
Figure 7:
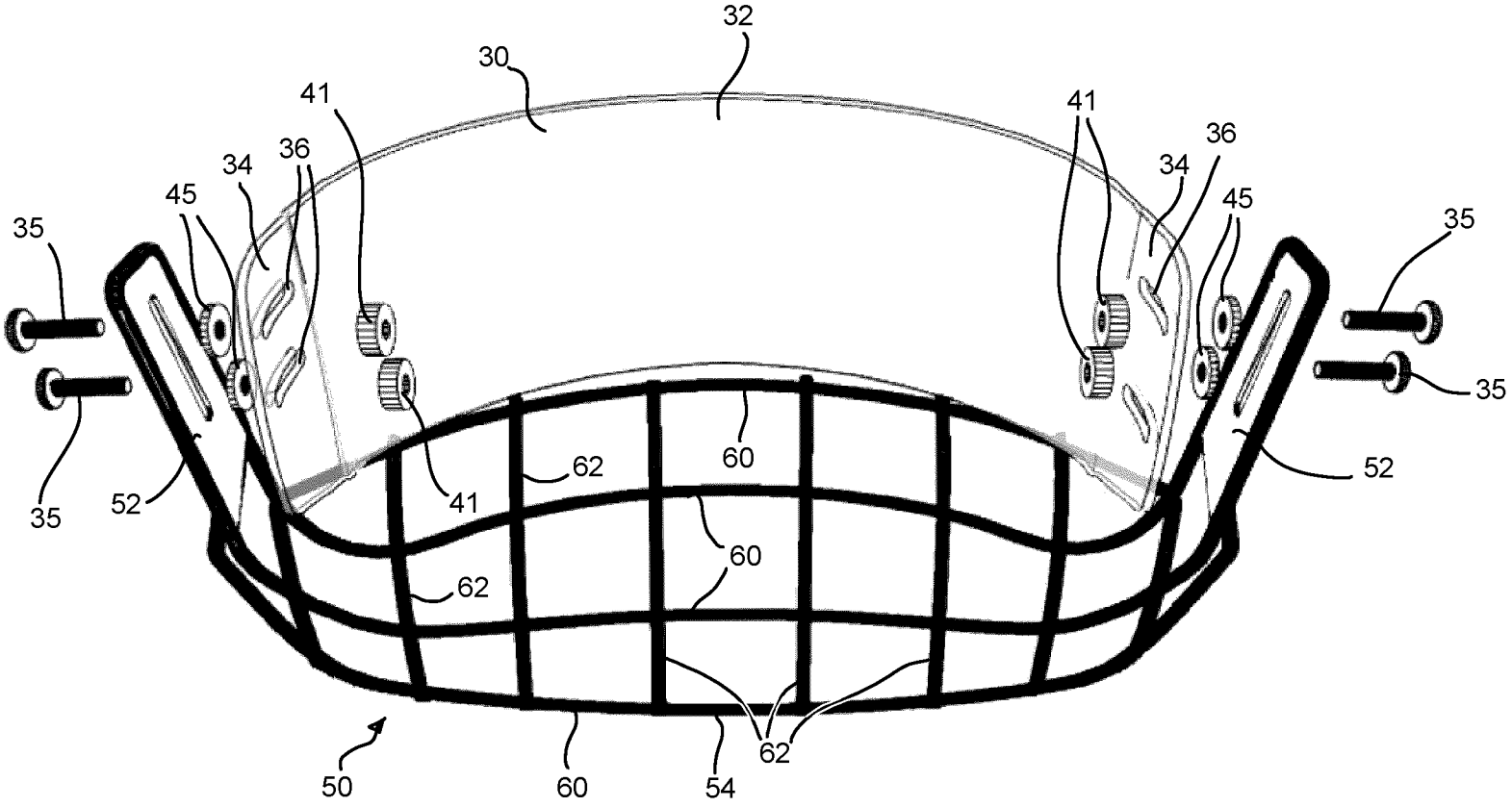
FIG. 7 is an exploded view of the visor and the lower protective cage of FIG. 5, shown from a rear perspective.

With reference to FIGS. 4 to 7, in order to connect the lower protective cage 50 to the outer shell 12 together with the visor 30, first the visor 30 is positioned such that the slots 36 of the visor connecting portions 34 are aligned with the two openings defined by the outer shell 12 (which are configured to receive the fasteners 35). Optionally, as shown in FIG. 6, spacers 41 are positioned between the visor connecting portions 34 and the lateral portions 16 of the outer shell 12 to space the visor 30 from the outer shell 12. Notably, the spacers 41 are washers defining openings for receiving respective ones of the fasteners 35. Once the visor 30 is positioned in place, the lower protective cage 50 is positioned such that the left and right connectors 52 overlap the left and right visor connecting portions 34. As such, the left and right visor connecting portions 34 are disposed between the lateral portions 16 of the outer shell 12 and the left and right connectors 52 of the lower protective cage 50. Optionally, spacers 45 can be inserted between the left and right connectors 52 and the left and right lateral portions 16 of the outer shell 12, and more specifically between the left and right connectors 52 and the left and right visor connecting portions 34, in order to adjust a spacing between the left and right connectors 52. In this embodiment, the spacers 45 are washers defining openings to receive respective ones of the fasteners 35.

As shown in FIGS. 1 and 2, when the left and right connectors 52 overlap the visor connecting portions 34, each slot 58 of the left and right connectors 52 extends across the slots 36 of the corresponding visor connecting portion 34. The slots 58 of the left and right connectors 52 extend generally transversally to the direction of the slots 36. Notably, the slots 58 of the left and right connectors 52 extend generally vertically while the slots 36 of the visor connecting portions 34 extend generally horizontally (i.e., generally parallel to the front-back axis FBA). With the left and right connectors 52 overlapping the visor connecting portions 34, on each side of the helmet 10, the two threaded fasteners 35 are inserted through the slot 58, through a corresponding one of the two slots 36 on each side of the visor 30, optionally through the spacers, and into engagement with one of the threaded tabs on the interior side of the outer shell 12 so as to secure the left and right connectors 52 to the left and right lateral portions 16 of the outer shell 12.

Before tightening the fasteners 35, the positions of the visor 30 and the lower protective cage 50 can be adjusted. Notably, the position of the visor 30 along the direction of the front-back axis FBA is adjusted by moving the visor 30 forwardly or backwardly. The slots 36 allow the forward or rearward movement of the visor 30 as the fasteners 35 are moved along the length of the slots 36. The visor 30 can thus be moved to be closer or further from the user's face. Similarly, the vertical position of the lower protective cage 50 is adjusted by moving by moving the lower protective cage 50 upwardly or downwardly. The slots 58 allow the vertical movement of the lower protective cage 50 as the fasteners 35 are moved along the length of the slots 58. Moreover, as explained above, the orientation of the slots 58 is such that moving the fasteners 35 along the slots 58 also results in a slight forward or rearward movement of the lower protective cage 50 (i.e., along the front-back axis FBA). In particular, moving the lower protective cage 50 vertically lower results in a slight forward movement of the lower protective cage 50, and moving the lower protective cage 50 vertically higher results in a slight rearward movement of the lower protective cage 50. This allows the lower protective cage 50 to be moved following an angle of the average user's face, namely since the face of a person with a longer face (i.e., extending longer along the vertical axis VA) will generally protrude forwardly more. In addition, the position of the lower protective cage 50 relative to the outer shell 12 is rotationally adjustable via the left and right connectors 52 since the lower protective cage 50 can be rotated slightly when the fasteners 35 are loose. Notably, the position of the lower protective cage 50 relative to the outer shell 12 may be rotationally adjustable between 10° and 30° inclusively. More specifically, in this embodiment, the position of the lower protective cage 50 relative to the outer shell 12 is rotationally adjustable by approximately 15° (±5°). This provides further adjustability for the position of the lower protective cage 50 to suit a particular user's preference and face shape.

As will be understood, the lower protective cage 50 can thus be adjusted to an uppermost position and a lowermost position, and a number of intermediate positions therebetween, to fit differently as the user desires. Not taking into account the rotational adjustment described above, the range of motion between the uppermost position and the lowermost position of the lower protective cage 50 may be between 1 cm and 4 cm inclusively. In some cases, the range of motion between the uppermost position and the lowermost position of the lower protective cage 50 may be between 1 cm and 3 cm inclusively. In this embodiment, the range of motion between the uppermost position and the lowermost position of the lower protective cage 50 is approximately 2 cm (±0.5 cm).

Once the visor 30 and the lower protective cage 50 are positioned as desired, the fasteners 35 are then tightened (e.g., with a screwdriver) to secure the visor 30 and the lower protective cage 50 in their adjusted positions. The visor 30 and the lower protective cage 50 can be readjusted at will by loosing the fasteners 35 and moving the visor 30 and/or the lower protective cage 50 as desired.

As will be understood from the above, the lower protective cage 50 can be adjusted according to the user's preference so as to make wearing the helmet 10 more comfortable for the user. This is in contrast to typical protective cages used in hockey helmets where the position of the cage when the cage is protecting the user's face is not adjustable. Moreover, the lower protective cage 50 is easily adjusted by the same adjustment mechanism as the visor 30 (i.e., via the fasteners 35). In addition, the lower protective cage 50 is connected to the outer shell 12 solely at the left and right lateral portions 16 thereof via the fasteners 35. Thus, the lower protective cage 50 can be adjusted with minimal additional parts (e.g., the spacers 45, if used) thereby implementing an inexpensive and simple adjustment mechanism for the lower protective cage 50.

In addition, the lower protective cage 50 can be adjusted so that the opening defined between the lower edge of the cage portion 54 and the lower edge of the rear portion 20 of the outer shell 12 is sized to fit the user's head therethrough. This allows the user to easily and quickly put the helmet 10 on his/her head and remove the helmet 10. Notably, the lower protective cage 50 does not need to be adjusted to remove or wear the helmet 10. In fact, the user can put on or remove the helmet 10 in a one-handed operation.

Furthermore, since the lower protective cage 50 is fastened to the outer shell 12 by the fasteners 35 so as to be held firmly in place, when the lower protective cage 50 is impacted (e.g., by a puck or a stick), the outer shell 12 absorbs the impact. This is in contrast to conventional protective cages for hockey helmets which, because of the way in which they are connected to the helmets and worn by players, can sometimes result in the user's chin absorbing a substantial part of an impact to the protective cage. Notably, conventional protective cages are often hinged to a front portion of the outer shell of the helmet and are held on the lateral sides by straps which are snapped onto the outer shell to keep the protective cage from opening during play. For comfort and practicality, many users loosen the straps holding the protective cage closed such that the protective cage can swing a certain amount when impacted. However, this can cause a chin cup secured to the protective cage to strike the user when the protective cage is impacted which, besides being uncomfortable, can be dangerous and lead to injury.

The helmet 10, including the visor 30 and the lower protective cage 50, provides the unencumbered field of vision associated with visors (in addition to protection to the upper portion of the user's face) while also providing protection to the lower portion of the user's face. Thus, the helmet 10 configured as described above offers the advantages of visors and protective cages while providing adjustability and ease of use.

Moreover, the lower protective cage 50 may be added to conventional visored helmets for adding protection for a lower portion of a user's face. Notably, the manner in which the visor 30 is described above being connected to the outer shell 12 corresponds to the same way in which many visors are typically connected to hockey helmets. Therefore, the lower protective cage 50 may be offered for sale on its own for a purchaser to install on his/her helmet to improve protection offered by the helmet.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A lower protective cage for a helmet, the lower protective cage comprising:

a left connector and a right connector, each configured to be adjustably connected to a left lateral portion and a right lateral portion of an outer shell of the helmet respectively, each of the left and right connectors defining a slot configured to receive fasteners therethrough to adjustably connect the left and right connectors to the outer shell of the helmet, the slot extending substantially vertically so that a position of the lower protective cage relative to the outer shell of the helmet is vertically adjustable via the left and right connectors; and a cage portion for protecting a lower portion of a user's face, the cage portion extending laterally between the left and right connectors, wherein the cage portion is directly secured to the helmet via standardized visor fixation holes, ensuring a stable and non-floating attachment, wherein the cage portion comprises:

a plurality of laterally-extending wires; and a plurality of vertically-extending wires connected to the laterally-extending wires to form a cage-like geometry of the cage portion, wherein a plurality of mounting plates are affixed to the wire cage using a six-dimple welding technique, allowing secure and adjustable positioning without a ratchet-type mechanism or a hinged visor system, and wherein the lower protective cage is made of metallic material, ensuring durability and impact resistance.

2. The lower protective cage of claim 1, wherein the lower protective cage is generally U-shaped when viewed from a front thereof.

3. The lower protective cage of claim 1, wherein the slot extends upwardly and rearwardly from a lower end to an upper end of the slot so that the position of the lower protective cage relative to the outer shell of the helmet is adjustable along a front-back axis of the helmet via the left and right connectors.

4. The lower protective cage of claim 1, wherein the left and right connectors extend upwardly from the cage portion.

5. The lower protective cage of claim 1, wherein:

the adjustability is achieved via elongated slots on both mounting plates, allowing vertical and rotational customization;

the slots enable precise alignment before final fixation with standardized helmet screws; and the cage is secured independently of any visor mechanism, without reliance on hinge or ratchet-based adjustments components.

6. The lower protective cage of claim 1, wherein:

the wire cage is structured to remain spaced from the user's face, creating a gap that prevents direct force transmission to the jaw, chin, or teeth;

impact energy is redirected to the helmet attachment points, thereby enhancing shock absorption relative to protectors that contact the user's face; and reduces the risk of dental and mandibular injury, providing protective functionality distinct from visors intended primarily for eye shielding.

7. The lower protective cage of claim 1, wherein:

the six-dimple welding configuration is designed to increase durability and distribute force evenly across the structure;

dimple welding points are strategically placed along the wire cage, preventing stress concentration and improving impact resistance; and the dimple welding points' pattern results in a structurally superior product compared to conventional welded cage designs.

8. The lower protective cage of claim 1, wherein:

the range of vertical motion between an uppermost position and a lowermost position of the lower protective cage is configured to be from about 1 cm to about 4 cm; and the adjustable slots allows for fine-tuned height adjustments, improving user fit and protection levels.

9. The lower protective cage of claim 1, wherein the position of the lower protective cage relative to the outer shell is configured to be rotationally adjustable via the left and right connectors, allowing both vertical and angular positioning.

10. The lower protective cage of claim 1, wherein each of the left and right connectors are configured to be fastened to the outer shell by a plurality of threaded fasteners, ensuring secure and customizable attachment.

11. The lower protective cage of claim 10, wherein, for each of the left and right connectors:

the left and right connectors define an elongated slot angled to approximate the slope of a human jaw, providing semi-vertical alignment for adjustability;

at least two fasteners of the plurality of threaded fasteners extend through the slot to secure the connector to a corresponding lateral portion of the outer shell; and the position of the lower protective cage relative to the outer shell is adjusted by moving the at least two fasteners along the slot, allowing precise customization for different helmet sizes and user preferences.

12. The lower protective cage of claim 1, wherein the cage portion is structurally independent of any visor component, ensuring modularity and allowing the user to replace or remove the visor without affecting the cage's functionality.

* * * * *